US006533036B1

(12) United States Patent
Baret et al.

(10) Patent No.: US 6,533,036 B1
(45) Date of Patent: Mar. 18, 2003

(54) METHOD AND A TOOL FOR TREATING THE WALL OF A CRITICAL ZONE IN A BOREHOLE

(75) Inventors: Jean-Francois Baret, Paris (FR); Bernard Montaron, Dubai (AE); Joel Rondeau, Antony (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/582,334

(22) PCT Filed: Dec. 21, 1998

(86) PCT No.: PCT/EP98/08536

§ 371 (c)(1),
(2), (4) Date: Jul. 31, 2000

(87) PCT Pub. No.: WO99/34093

PCT Pub. Date: Jul. 8, 1999

(30) Foreign Application Priority Data

Dec. 24, 1997 (FR) ..... 97 16500

(51) Int. Cl.[7] ..... E21B 33/13
(52) U.S. Cl. ..... 166/290; 405/249
(58) Field of Search ..... 166/268, 290, 166/66.6, 66.7; 405/249

(56) References Cited

U.S. PATENT DOCUMENTS 2,965,171 A * 12/1960 Howard et al. ..... 166/29
3,108,024 A * 10/1963 Battle ..... 118/403
3,977,360 A * 8/1976 Mihaly ..... 118/408
4,055,958 A * 11/1977 Hanson ..... 61/41 R
4,784,223 A * 11/1988 Worrall et al. ..... 166/287
4,867,240 A * 9/1989 Colla ..... 166/290
5,533,570 A * 7/1996 Streich et al. ..... 166/153
5,718,287 A * 2/1998 Streich et al. ..... 166/66.6

FOREIGN PATENT DOCUMENTS

EP 0722037 A * 7/1996 ..... E21B/33/16
EP 0777018 A1 * 6/1997 ..... E02D/5/34

* cited by examiner

*Primary Examiner*—David Bagnell
*Assistant Examiner*—Daniel Stephenson
(74) *Attorney, Agent, or Firm*—Stephen Schlather; Catherine Menes; Brigitte Jeffery

(57) ABSTRACT

The invention relates to a method and to a tool for treating at least one wall in a critical zone of a borehole, in particular a borehole for development of a hydrocarbon, water, gas or analogous field, the method consisting in reinforcing the wall of the critical zone by a coating obtained from a base fluid which is pumped from the surface to a tool (1) to be projected against the wall of the critical zone where it forms the coating once it has set, the method being characterized in that it consists in storing at least one additive or activator in liquid form in a reservoir (R) of the tool (1), and in projecting the additive simultaneously with the base fluid against the wall of the critical zone via at least one injector (I) in order to activate setting of the base fluid.

28 Claims, 10 Drawing Sheets

METHOD AND A TOOL FOR TREATING THE WALL OF A CRITICAL ZONE IN A BOREHOLE

The present invention relates to a method and a tool for treating at least the wall of a critical zone in a borehole, in particular a borehole for developing a hydrocarbon, gas, water, or analogous field.

A hydrocarbon, water, or gas field is generally developed using a drilling tool such as a drill bit which is rotatably driven from the surface, with transmission being via a drill pipe, or by a motor which is located at drilling tool level and which is mounted at the end of a drill pipe or a coiled tubing.

During the entire drilling operation, a drilling fluid—commonly known as "mud"—is pumped into the hole through the drilling tool. The mud cools the drilling tool and keeps the drilling debris in suspension to enable it to be evacuated to the surface. Another essential function of the mud is to ensure the safety of the well by providing hydrostatic pressure which is higher than the pore pressure of the formation, thus preventing any inadvertent upflow of gas or other fluids. However, the hydrostatic pressure must not exceed the fracture pressure of the rock.

Depending on the depth and type of formations encountered, that balance requires the use of muds of different densities which are incompatible with zones which have already been drilled at lesser depths. As a result, drilling has to be interrupted to position a casing to protect the zones which have already been drilled. Each interruption in drilling then corresponds to a reduction in hole diameter. If a number of critical zones are passed through, the well may have to be abandoned.

It would thus be desirable to have techniques available for at least temporarily treating such critical zones to limit the duration and cost of interruptions to drilling, and to do so with no substantial reduction in the hole diameter.

European patent EP-A-0,777,018 describes a technique for cementing a foundation shaft in the civil engineering industry.

In that document, a shaft is dug that is not necessarily of constant diameter because of the different hardnesses of the rocks through which the bit passes. In order to obtain a foundation shaft of substantially constant diameter, the wall of the shaft is cemented using a tool which is mounted above the bit. Thus, once the shaft is dug, the tool is activated to project a cement slurry against the wall of the shaft as the bit is raised, the body of the tool smoothing the slurry. In practice, the slurry must have a relatively fast setting time, and thus use is made of a Portland cement to which an activator, such as a silicate, has been added to increase the setting speed of the slurry which is pumped from the surface and guided by tubes which open laterally into the tool body.

Defining the composition of a cement slurry is a very complex problem which is difficult to master, in particular as regards selecting which additive(s) to add to the slurry to retard or activate setting, and in what proportion(s).

Such a problem can be solved without too much difficulty for cementing a foundation shaft which is only a few meters deep, as envisaged in the document cited above. The slurry which is pumped from the surface rapidly reaches the tool which projects it against the wall of the shaft.

In contrast, the problem becomes more difficult in the field of drilling to develop hydrocarbon, water, or gas wells which can be very deep, of the order of several hundreds of meters.

A critical zone which must be treated in a borehole may be located at any depth, and so a cement slurry must be controlled to set at the depth at which the critical zone is located, since the slurry must remain fluid until the critical zone is reached. Further, temperature is a parameter which influences slurry setting time, and must be taken into account since temperature increases with borehole depth.

In general, the invention consists both in a method which can control setting of a base fluid used to form a protective coating in a critical zone in a borehole whatever the depth at which the critical zone is located, and in a tool for carrying out this method.

The invention thus provides a method of treating at least the wall of a critical zone in a borehole, in particular a hole for developing a hydrocarbon, water, or analogous field, the method consisting in reinforcing the wall of the critical zone with a coating obtained from a base fluid which is pumped from the surface to a tool to be projected against the wall of the critical zone where it forms said coating once it has set, the method being characterized in that it consists in storing at least one additive or activator in liquid form in a reservoir of the tool, and in projecting the additive simultaneously with the base fluid against the wall of the critical zone to activate setting of the base fluid.

According to another feature, the method consists in raising the tool along the critical zone, while simultaneously projecting the base fluid and the additive by means of at least one injector, and in providing the tool with slip formwork located beneath the injector to keep the base fluid on the wall of the critical zone for a time equal to that required for the base fluid to set.

The invention also provides a tool for carrying out the method, the tool being mounted at the end of tubing to receive a base fluid which is pumped from the surface through the tubing and to project it against the wall of a critical zone detected in a borehole at any depth, the tool being characterized in that it comprises at least:

- a reservoir in which an activator is stored to activate setting of the base fluid pumped from the surface and guided to the tool;
- injectors to project both the base fluid and the activator simultaneously against the wall of the critical zone; and
- a control means activated from the surface to control the operation of the injectors.

As an example, the tool is constituted by at least:

- a connection module for connecting the tool to the tubing;
- an injection module which comprises at least one reservoir containing an additive or activator in liquid form, and at least one injector to project both the base fluid and the activator simultaneously against the wall of the critical zone; and
- a module forming slip formwork located beneath the injector to keep the projected base fluid on the wall in the critical zone for a time equal to that required for the base fluid to set, while the tool is being raised.

A number of embodiments of the tool can be envisaged. The tool can be used alone or in combination with a drilling tool.

When the wall of a critical zone is protected by a cement coating, the base fluid pumped from the surface is advantageously that described in the patent application filed on the same day by the Applicant, entitled "Controlling setting of a high-alumina cement" (inventor: Michel MICHAUX).

Further characteristics, advantages and details of the invention become apparent from the description below, made with reference to the accompanying drawings which are given solely by way of example and in which:

FIGS. 1*a* and 1*b* schematically illustrate the principle of treating a critical zone in a borehole using the method of the invention;

Figure 2:
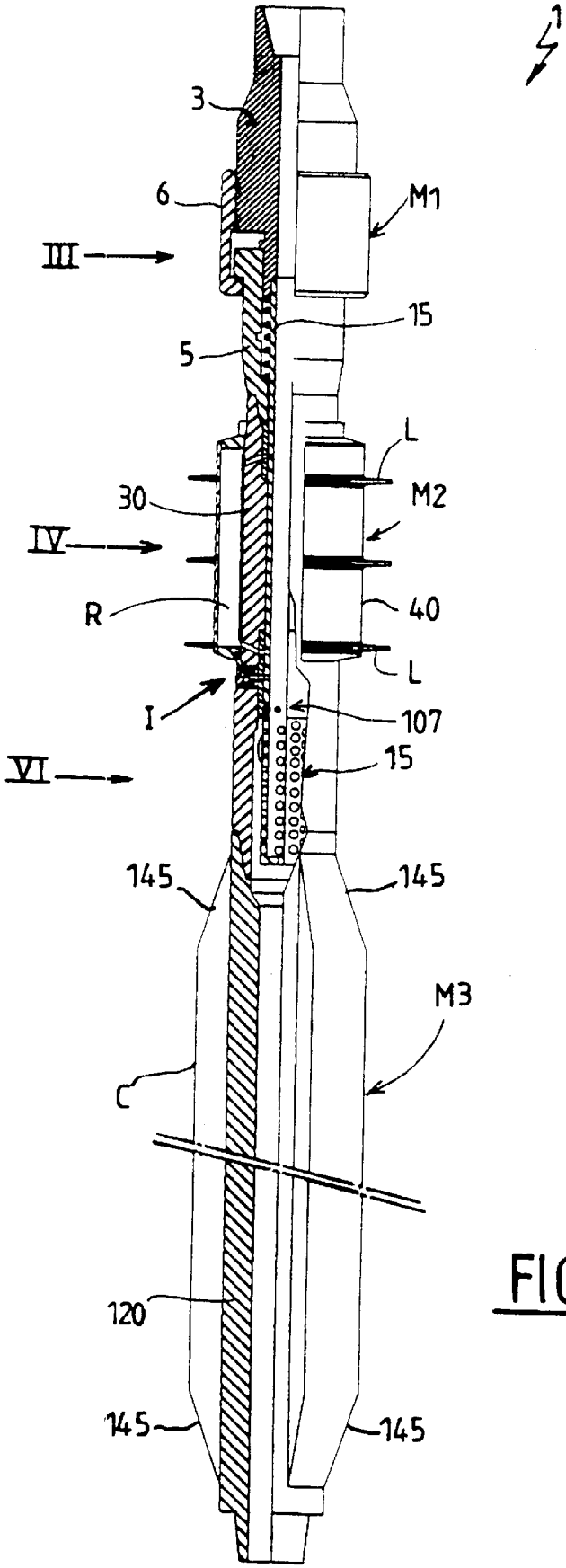
FIG. 2 is a partial cross section of an embodiment of a tool for carrying out the method of the invention, the tool comprising a connection module, an injection module, and a module forming slip formwork.
Figure 3:
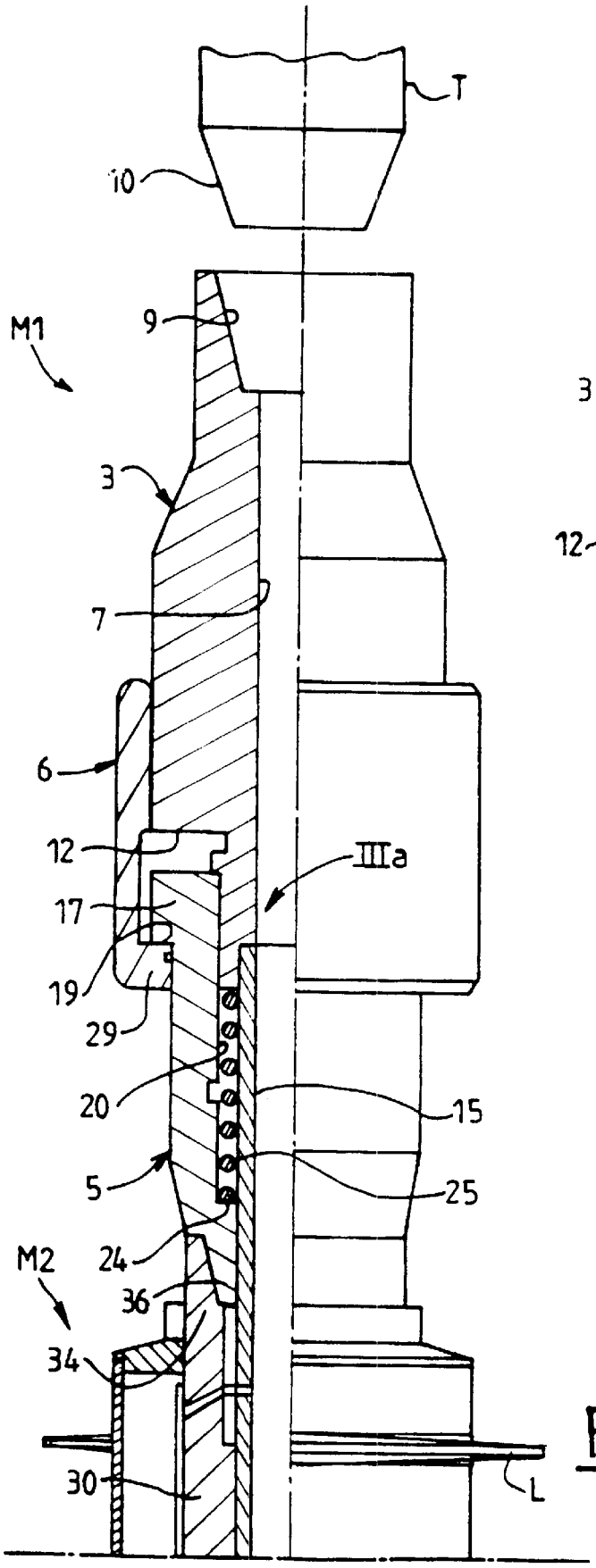
FIG. 3 is an enlarged view along arrow III in FIG. 2 to illustrate the connection module of the tool.
Figure 3A:
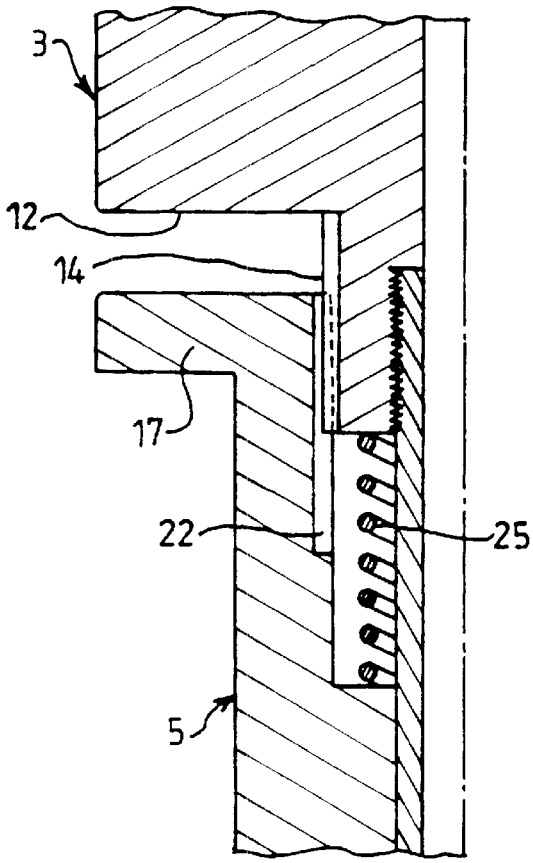
Figure 4:
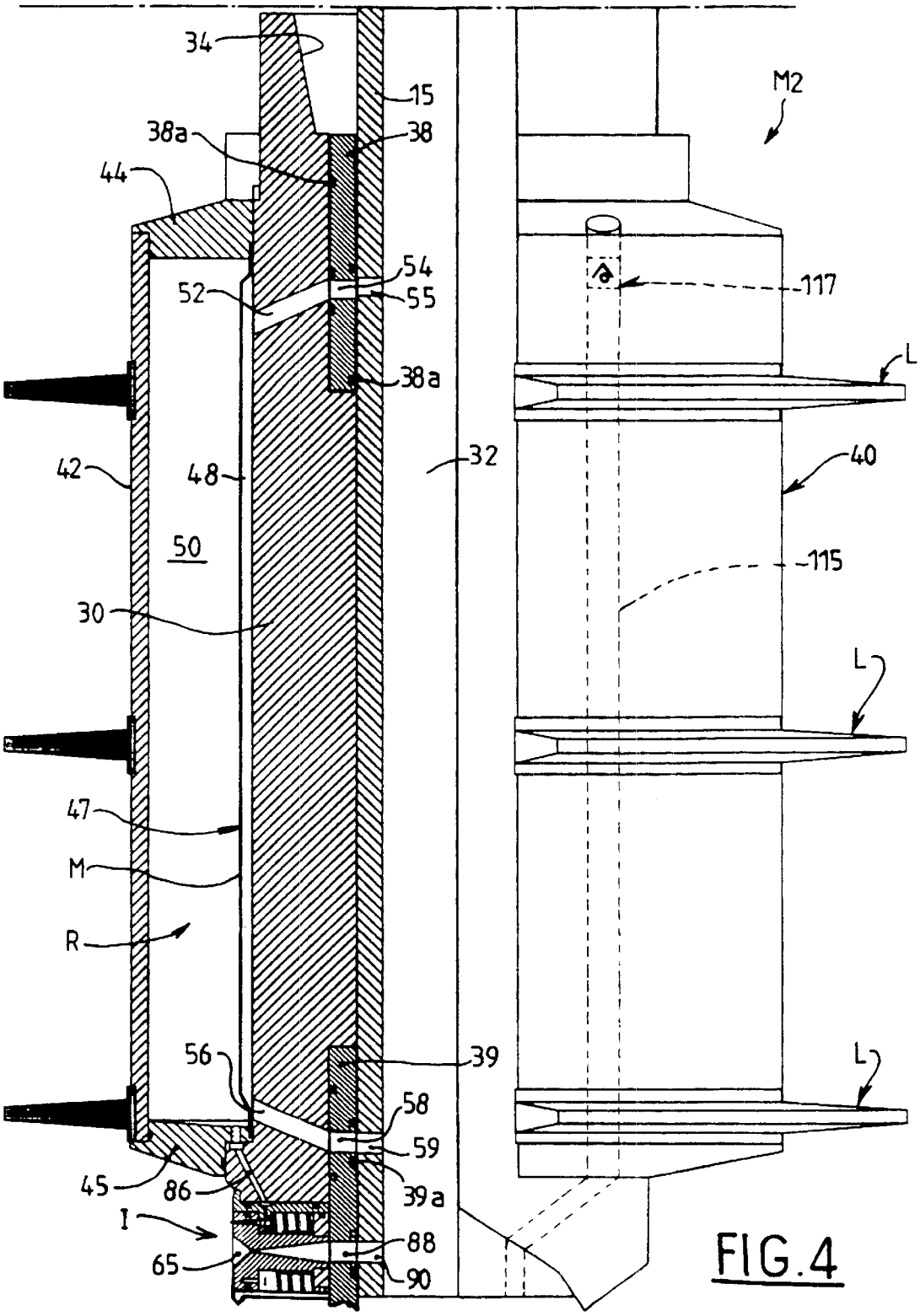
Figure 5:
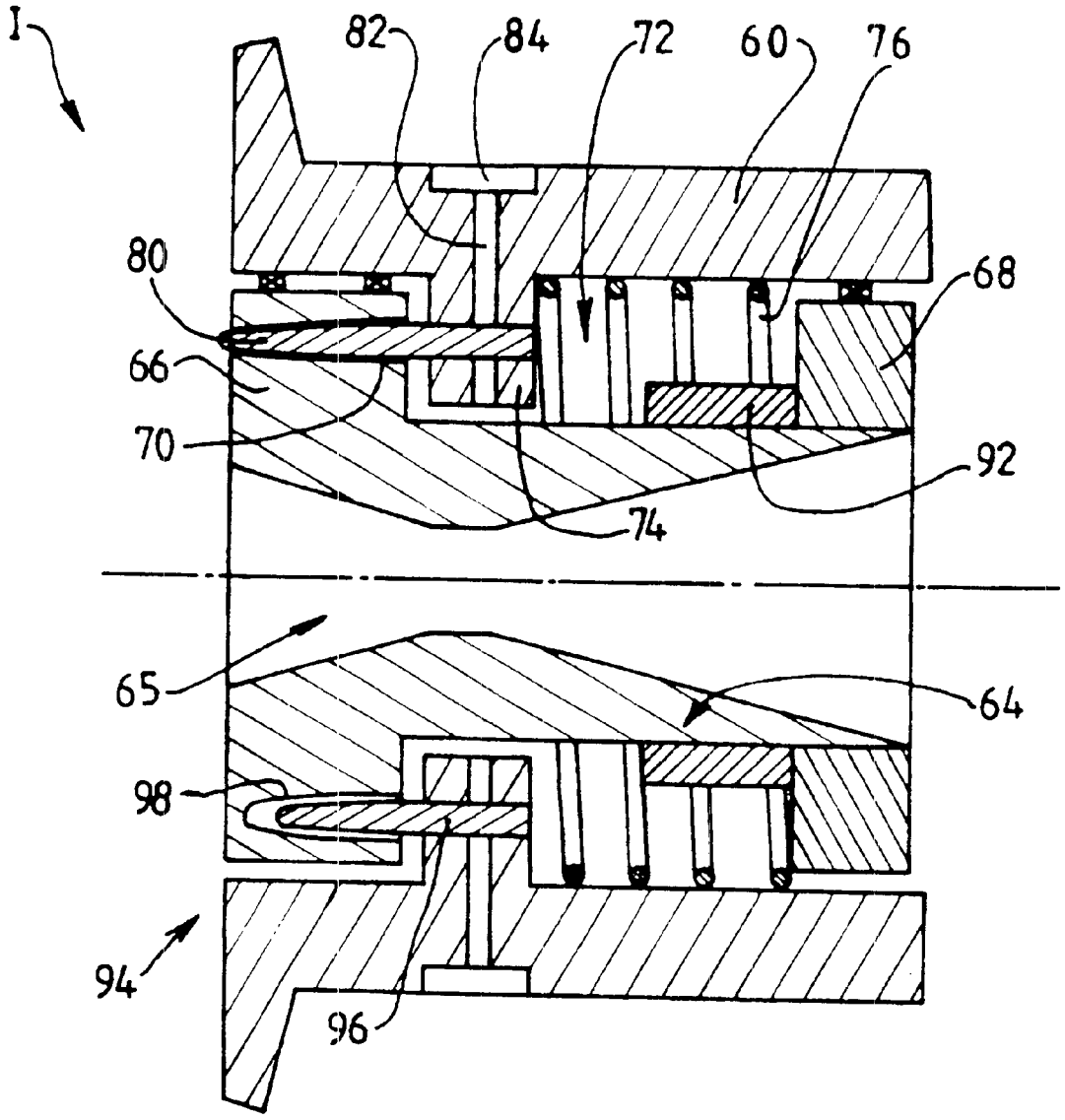
Figure 6:
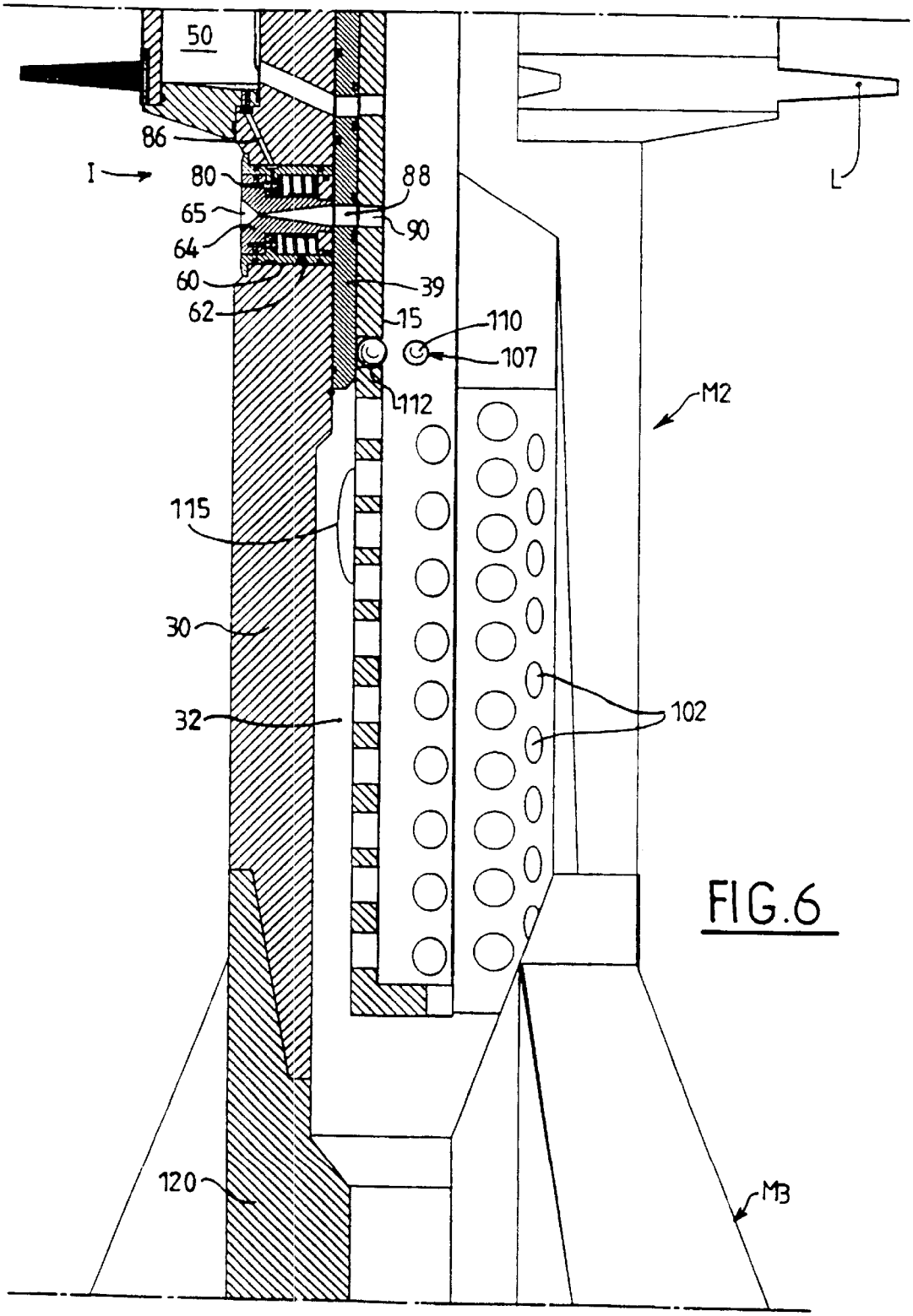
Figure 7:
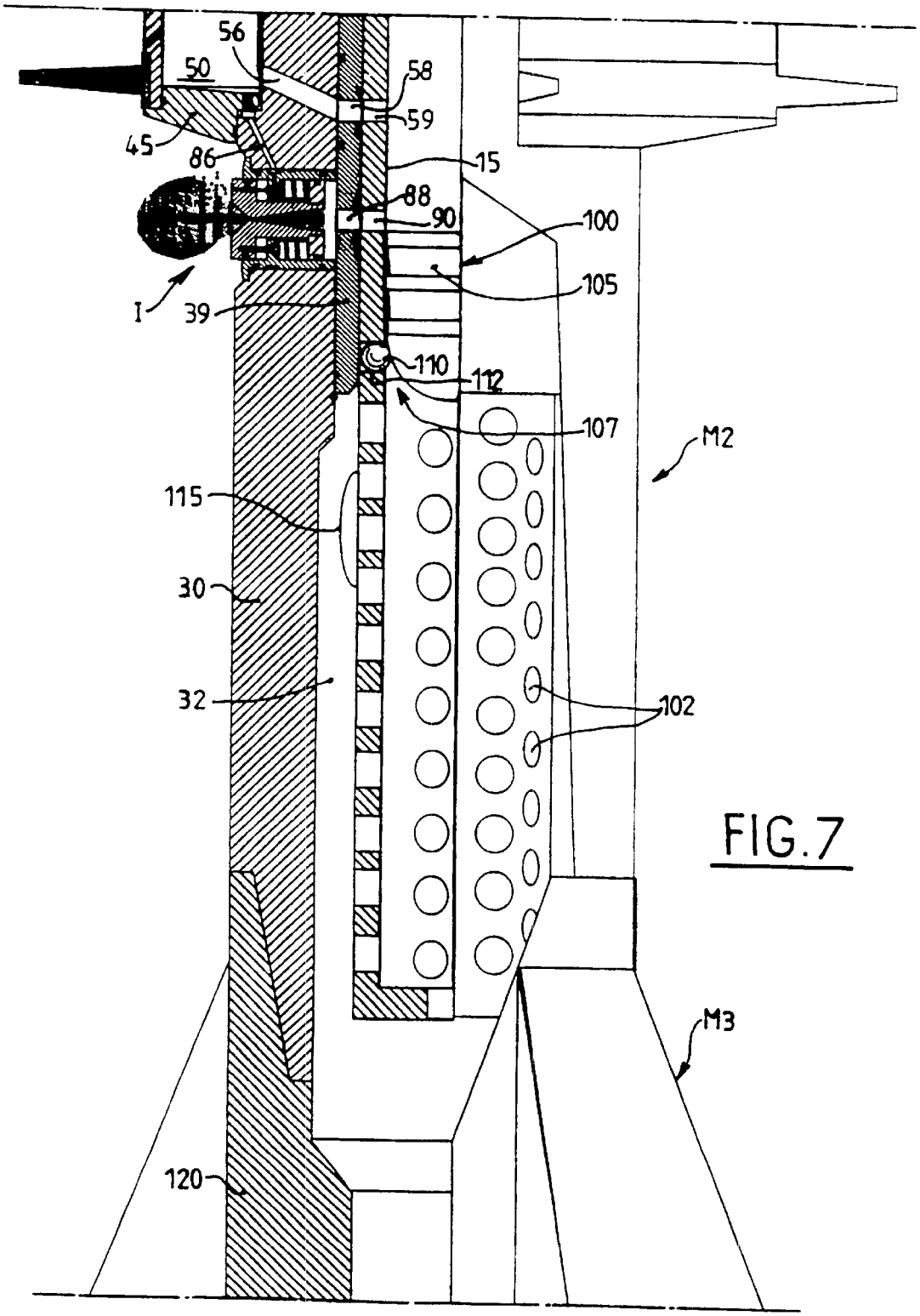
Figure 8:
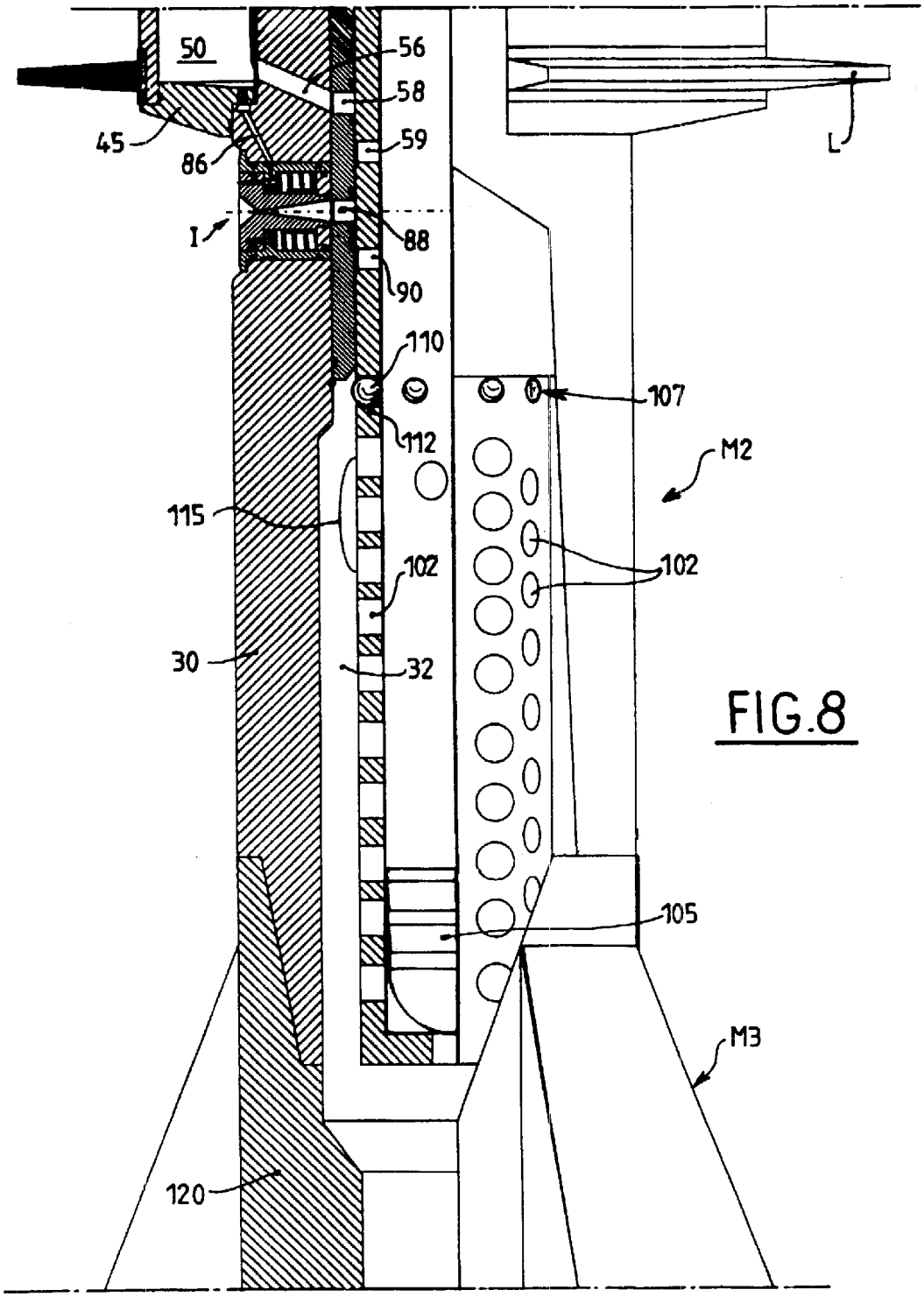
Figure 9:
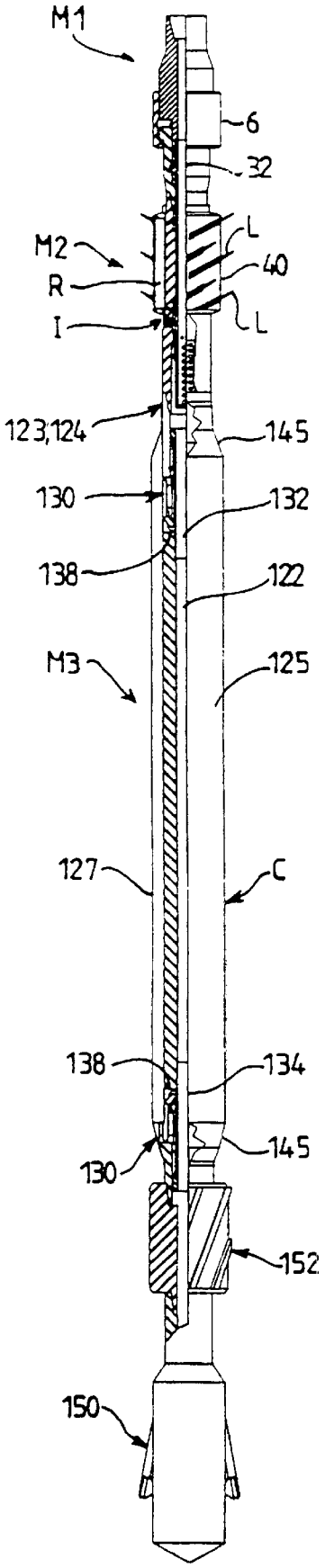
Figure 10A:
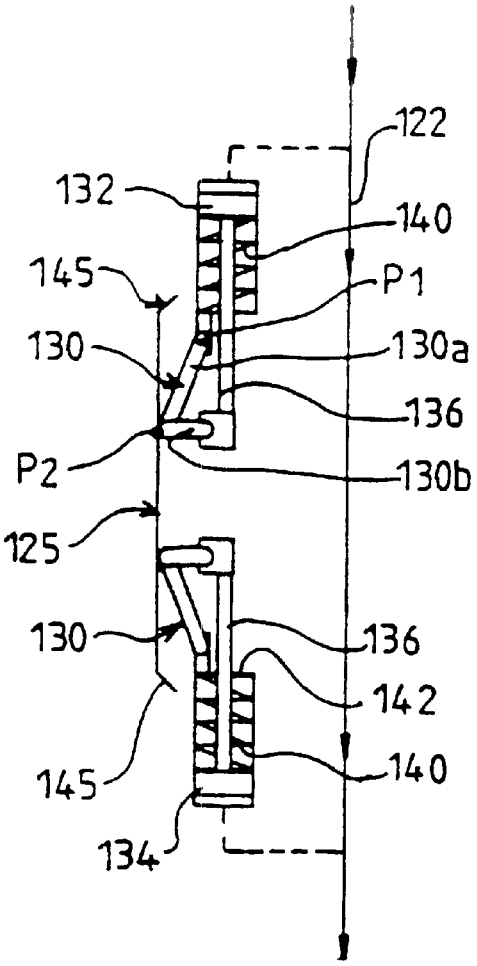
Figure 10B:
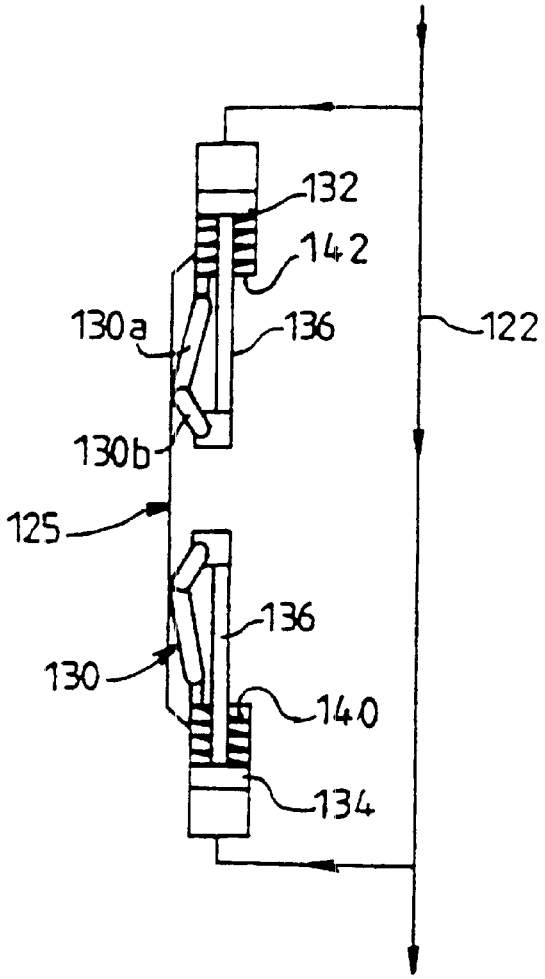

FIG. 3*a* is a detail view along arrow IIIa of FIG. 3;

FIG. 4 is an enlarged view along arrow IV in FIG. 2 to illustrate the upper portion of the injection module of the tool;

FIG. 5 is a schematic diagram of an injector of the injection module of the tool;

FIG. 6 is an enlarged view along arrow VI in FIG. 2 to illustrate the lower portion of the injection module of the tool;

FIGS. 7 and 8 are views similar to FIG. 6 to illustrate the operation of the tool;

FIG. 9 is a schematic cross section of a preferred embodiment of the tool of the invention; and FIGS. 10*a* and 10*b* are simplified views to illustrate the principle on which the shutters of the slip formwork of the tool are controlled.

When drilling a section of a hole or well to develop a hydrocarbon field, for example, the drilling tool passes through various formations which have different mechanical properties which are not always compatible with the density of the drilling mud used. This results in the appearance of critical zones, the walls of which must be reinforced before drilling can be continued, for the reasons given above.

Figure 1A:
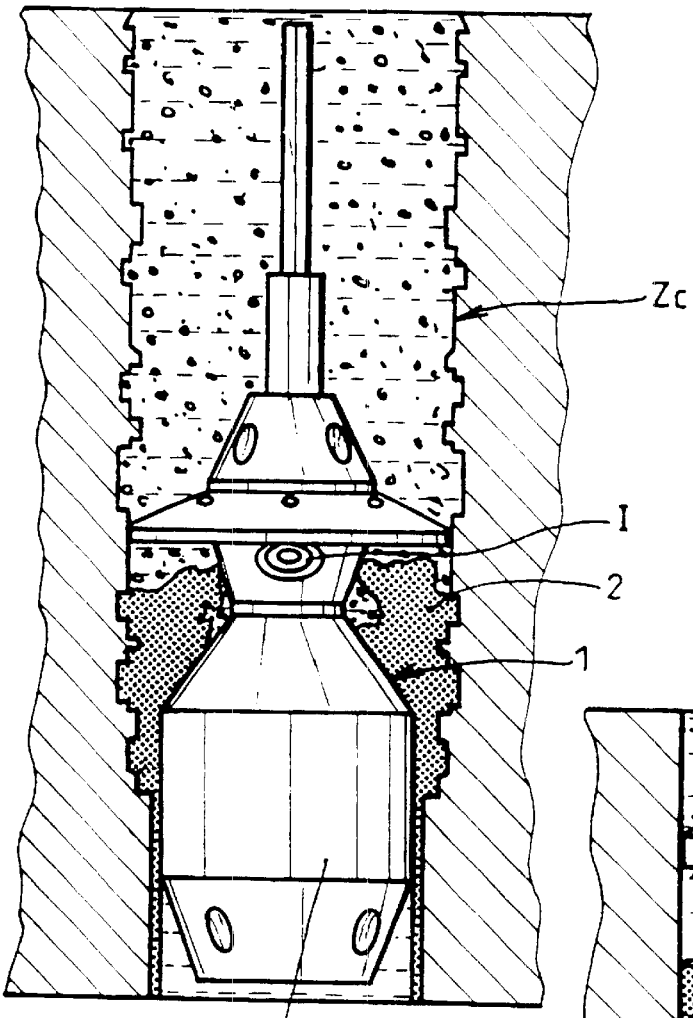
Figure 1B:
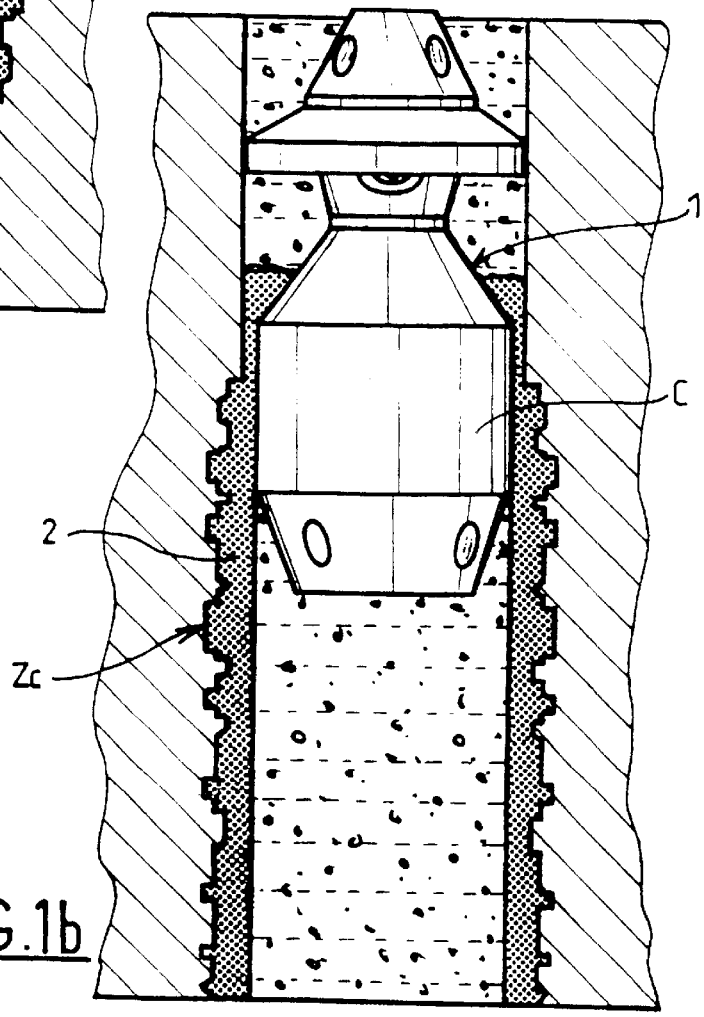

FIGS. 1*a* and 1*b* schematically illustrate a section of a borehole in which a critical zone Zc has been detected. With the drilling operation temporarily suspended, this critical zone Zc is treated to form a reinforcing or protective coating 2 on the wall of the critical zone Zc using the method and tool 1 of the invention.

In general, this treatment consists of pumping a base fluid from the surface and projecting it against the wall of the critical zone Zc. However, since a coating is only obtained once the base fluid has set, at least one additive or activator is also projected to activate and accelerate setting of the base fluid.

The method of the invention consists in storing the activator in liquid form in a reservoir disposed in the tool, in projecting it simultaneously with the base fluid against the wall of critical zone Zc using at least one injector I, and while tool 1 is being raised along the critical zone Zc, in using slip formwork C located below injector I to hold the projected base fluid on the wall for a period of time which is equal to that required for the fluid to set.

In order to obtain a coating with substantially constant internal diameter over the entire length of critical zone Zc, the method of the invention also comprises regulating the rate at which the tools is raised as a function of the resistance provided by the base fluid while it is setting and bearing against the top of slip formwork C.

To show the principle of the method schematically illustrated in FIGS. 1*a* and 1*b*, tool 1 is considered as being used on its own by being mounted at the end of tubing T. This assumes that the drilling tool has been lifted to the surface to allow tool 1 to be lowered.

However, the method of the invention can also be carried out using a tool 1 in combination with a drilling tool.

Such a combination is shown in a preferred embodiment of the method which is described below with reference to the other figures.

The tool illustrated in FIG. 2 comprises three successive modules M1, M2, and M3 in axial alignment, namely: a connection module M1, an injection module M2, and a module M3 forming slip formwork.

To facilitate the following description, tool 1 is considered to be in a vertical position so that the adjectives "upper" and "top" correspond to the portion of the tool nearest the surface, and the adjectives "lower" and "bottom" correspond to the portion of the tool nearest the bottom of the well.

Connection module M1 connects injection module M2 to the end of tubing T. Module M1 illustrated in FIG. 3 comprises axially aligned upper and lower tubular elements 3 and 5, which are partially inserted one inside the other and connected together by means of a nut 6, so that lower element 5 can he axially displaced in translation relative to upper element 3.

Upper element 3 is connected to the tubing T by a screw-and-nut type fastening. The top end of a central channel 7 which passes through upper element 3 opens out to form a threaded annular frustoconical female endpiece 9 to receive a threaded annular male endpiece 10 of complementary shape provided at the bottom end of tubing T. Towards its bottom end, the outside diameter of upper element 3 is reduced to define an annular shoulder 12. Beyond this shoulder 12, the outer wall of upper element 3 includes fluting 14 (FIG. 3*a*) which extends parallel to the axis of upper element 3 and which is open at its bottom end, while the inside wall of central channel 7 is threaded to screw onto the threaded top end of a central liner 15 which penetrates into the inside of an injection module M2 as is described below.

The top end of lower element 5 of connection module M1 has a collar 17 which defines an annular shoulder 19 with the body of lower element 5. A central channel 20 passes through lower element 5, and the inner wall of the upper portion of this channel 20 has fluting 22 (FIG. 3*a*) which is complementary in shape to the fluting 14 of upper element 3. Towards its bottom end, the diameter of the inner wall of channel 20 is reduced to define an annular shoulder 24.

During assembly, the upper and lower elements 3 and 5 are inserted one inside the other via their respective fluting 14 and 22. The two ends of a spring 25 mounted inside central channel 20 of lower element 5 bear respectively on shoulder 24 of lower element 5 and on the face of the bottom end of upper element 3. Nut 6 is slidably mounted around lower element 5 and only its screws onto the outer threaded wall of upper element 3. The bottom end of nut 6 has an inwardly-directed rim 29 on which shoulder 17 of lower element 5 bears under the action of spring 25 urging upper element 3 away from lower element 5.

However close or far apart the upper and lower elements 3 and 5 may be, connection module M1 always ensures fluid communication between tubing T and injection module M2 through central channel 7 of connection module M1, which is axially aligned with central liner 15. Upper and lower elements 3 and 5 are advantageously dimensioned so that the fluid flow section corresponds to the inside diameter of central liner 15.

Injection module M2 (FIG. 3) is mounted in line with connection module M1 and comprises a tubular body 30 having its top end fixed to the bottom end of lower element 5 of connection module M1 by a screw-and-nut type fastening. The inside wall of the top end of a central channel 32 of body 30 is tapered and threaded to form an annular frustoconical female endpiece 34 which screws onto threaded annular frustoconical male endpiece 36 of complementary shape provided at the bottom end of lower element 5 of connection module Ml.

Referring to FIG. 4, central liner 15 is freely mounted inside channel 32 of body 30, with interposition of an upper guide sleeve 38 mounted in the upper portion of channel 32 and a lower guide sleeve 39 mounted in the lower portion of channel 32. Sleeves 38 and 39 are integral with body 30 and include inner and outer grooves 38*a* and 39*a* in which O-rings (not shown) are mounted to ensure sealing.

Injection module M2 projects base fluid pumped from the surface through tubing T and connection module M2. Projection against the wall of critical zone Zc is effected by at least one injector I which also simultaneously projects an activator to activate and accelerate setting of the base fluid to form the coating.

The activator is stored in a reservoir R located in injection module M2. As an example, an enclosure 40 is provided in the upper portion of body 30 of injection module M2. This enclosure 40 is constituted by a cylindrical wall 42 coaxially mounted around body 30 and closed by annular upper and lower caps 44 and 45 fixed to body 30. The inside volume of enclosure 40 is separated into two parts by a pressure and volume compensating means 47 constituted by an elastically deformable element such as a rubber membrane M. Membrane M is cylindrical and its two ends are fixed to body 32 by means of the caps 44 and 45.

Thus the inside of enclosure 40 is subdivided into an inner annular chamber 48 and an outer annular chamber 50 which forms reservoir R for the activator. Fluid circulation in chamber 48 is ensured by central liner 15. The upper portion of chamber 48 can communicate with the inside of central liner 15 via a radial channel 52 passing through body 30, a lateral opening 54 passing through upper sleeve 38, and a lateral opening 55 passing through central liner 15. In analogous fashion, the lower portion of chamber 48 can communicate with the inside of central liner 15 via a radial channel 56 passing through body 30, a lateral opening 58 passing through lower sleeve 39, and a lateral opening 59 passing through the wall of central liner 15.

Elastically deformable toroidal flanges L are mounted around the outer wall 42 of enclosure 40. The outside diameter of the regularly spaced flanges L is advantageously greater than the enlarged diameter of the critical zone to be treated. These flanges L center tool 1 during its displacement and also separate the fluids.

Body 30 of injection module M2 carries 3 injectors I, for example, which are mounted in body 30 and located beneath enclosure 40 containing reservoir R.

Each injector I (FIG. 6) is mounted in a bush 60 fixed and sealed in a lateral opening 62 passing through body 30 of injection module M2. Each injector I (FIG. 5) comprises a piston 64 with a main central channel 65 passing through its body to eject and project base fluid pumped through central liner 15 against the wall of the critical zone. The fluid flow section of the central channel 65 is not uniform but has two opposed truncated cone shapes in order to produce the known Venturi effect.

Piston 64 is in slidable and sealed contact with bush 60 by means of front 66 and rear 68 collars. Front collar 66, which corresponds to the outlet from central channel 65, has a secondary channel 70 passing through it axially for ejecting activator stored in reservoir R. Rear collar 68 is formed by an annular cap which screws onto the piston body 64.

The front 66 and rear 68 collars define an annular space 72. An annular rib 74 projecting from the internal wall of bush 60 penetrates into this annular space 72. The two ends of a spring 76 lodged in this space 72 and mounted around piston 64 bear on the rib 74 and on the rear collar 68 of piston 64 respectively. In secondary channel 70, an elongate finger or needle 80 carried by rib 74 engages the activator outlet.

The annular space 72 is in permanent communication with reservoir R. Rib 74 and bush 60 have a channel 82 passing through them radially and communicating with a peripheral groove 84 provided in the outer wall of bush 60. A channel 86 passes through body 30 of injection module M2 and through lower cap 45 to provide a fluid connection between groove 84 and reservoir R.

The main base fluid outlet channel 65 can communicate with the interior of central liner 15 via an opening 88 passing through lower sleeve 39 and an opening 90 passing through the wall of central liner 15.

Piston body 66 of each injector I can take up two positions. In a first "retracted" position, rear collar 68 is in contact with the lower sleeve 39 by the action of return spring 76, such that needle 80 passes through the whole of secondary channel 70 and blocks its fluid flow section. In the second position, part of piston 64 projects beyond bush 60 and compresses spring 76 to partially disengage needle 80 to free the fluid flow section of secondary outlet channel 70. A cylindrical part 92 mounted coaxially around piston body 66 limits the stroke of injector I as it moves to its second position.

Advantageously, at least one guide means 94 centers and guides piston 64 of injector I. This guide means 94 is constituted by a second finger or needle 96 carried by rib 74 which engages in a blind hole 98 formed in front collar 69.

The position of piston 64 of injectors I is defined by a control means 100 described below with reference to FIGS. 6 and 7.

Central liner 15 extends inside body 30 of injection module M2 beyond lower sleeve 39. The bottom of central liner 15 is at least partially blocked and its bottom end is pierced by a plurality of openings 102. These openings 102 ensure fluid communication between central liner 15 and the central channel 32 of body 30 the diameter of which has been enlarged down to its bottom end.

Control means 100 (FIG. 7) comprises a projectile such as a spike or dart 105 which is dropped from the surface into tubing T. A retaining means 107 is provided in the central liner 15 to temporarily block dart 105 before it drops to the bottom of central liner 15. Retaining means 107 is mounted above openings 102 of central liner 15 and at a level which is located just before the bottom end of lower sleeve 39 of body 30. Retaining means 107 comprises retractable fingers 110 which are lodged in openings 112 formed around central liner 15 and located at the same level. These fingers 110 bear on the outer wall of lower sleeve 39 to project slightly inside central liner 15 to stop dart 105 which automatically activates injectors I as described below.

The periphery of dart 105 is advantageously equipped with elastically deformable flanges, made of rubber for example. During its fall, dart 105 separates the fluids, namely drilling mud already contained in tubing T and base fluid pumped behind dart 105. Once stopped in central liner 15, dart 105 acts as a seal to force the base fluid to be directed towards injectors I.

As tool 1 rises, volume compensation inside and outside tool 1 must be ensured. Fluid communication is ensured by at least one duct 115 which passes through reservoir R. This duct 115 opens to the outside through upper cap 44 of chamber 40 and inside channel 32 of the injection module at a level located below retaining means 107 for projectile 105. An anti-return valve 117 is lodged in duct 115, for example at the level of upper cap 44 of enclosure 40. This valve 117 establishes fluid circulation in one direction only, namely from top to bottom i.e., from the outside to the inside of tool 1.

Module M3 forms slip formwork C which is mounted in the extension of injection module M2. Slip formwork C keeps the base fluid on the wall in critical zone Zc for a time equal to that required for the fluid to set as tool 1 rises along the critical zone Zc.

Module M3 (FIG. 9) comprises a tubular body 120 which defines a central channel 122 located in an extension of central channel 32 of body 30 of injection module M2. The top end of body 120 is arranged so as to form a threaded annular truncated cone-shaped female endpiece 123 which screws onto a threaded annular truncated cone-shaped male endpiece 124 provided at the bottom end of body 30 of injection module M2.

Slip formwork C is constituted by three extensible shutters 125 mounted around body 120 to form a substantially cylindrical envelope around which an elastic membrane 127, made of rubber for example, is mounted to ensure continuity of the envelope between the deployed and retracted positions of shutters 125.

FIGS. 10*a* and 10*b* illustrate the control of shutters 125 in a deployed position (FUG. 10*a*) and in a retracted position (FIG. 10*b*), the direction of fluid circulation being indicated by arrows.

Each shutter 125 is controlled by an upper set of rods 130 associated with an upper piston 132 and by a lower set of rods 130 associated with a lower piston 134. Each set of rods comprises a rod 130*a*, one end of which is hinged to a fixed point P1 on body 120, and a rod 130*b* one end of which is hinged to the free end of a shaft 136 which extends the associated piston 132 or 134. The two free ends of the two rods 130*a* and 130*b* are hinged to shutter 125 at a point P2 through a slot 138 (FIG. 9) passing through body 120.

The two pistons 132 and 134 are hollow, and the shaft 136 of each piston is constituted by a sleeve. The two pistons 132 and 134 are in axial alignment and are mounted in a recess in the body 120 of module M3. A return spring 140 is mounted around each shaft or sleeve 136 and its two ends bear respectively on piston 132 or 134 and on a fixed point formed by a shoulder 142 of body 120.

In general, the rod mechanisms 130 are designed so that a force exerted downwards on the shutters 125 tends to deploy them, while a force exerted upwards tends to retract them against body 120. The two pistons 132 and 134 are kept away from each other by the action of return springs 140 such that deformation of the rods 130 causes retraction or deployment of the shutters 125. The maximum diameter of the envelope defined by shutters 125 is always less than the diameter of the borehole so as to leave an annular space, for example of the order of a few millimeters.

The upper and lower portions of shutters 125 are conical in shape 145 to provide lower resistance during displacement of tool 1 and also to measure the resistance provided by the base fluid (FIGS. 2 and 9).

Module M3, which carries the slip formwork C, is axially connected to a drilling tool 150 via a screw type fastening lug 152 (FIG. 9).

In the embodiment shown in FIG. 9, flanges L which surround enclosure 40 of injection module M2 are advantageously mounted obliquely to facilitate circulation of drilling fluid and the upflow of debris when drilling tool 150 is in action.

The general operation of tool 1 is now described.

The well drilling operation is interrupted when the drilling tool 150 has passed through a critical zone Zc which is detected at the surface. Tool 1 is then used to treat the wall of critical zone Zc without needing to lift drilling tool 150 to the surface.

Drilling tool 150 can advantageously be used to carry out a prior treatment which consists of enlarging the diameter of critical zone Zc so that the thickness of the protective coating which will be formed on the wall does not reduce the diameter of the borehole substantially. The resistance provided by the rock to the drilling tool 150 generates a reaction which is applied upwards to the tool 1. This reaction force is transmitted to lower element 5 of connection module M1 which moves in translation towards the upper element 3 of module M1 and compresses return spring 25 mounted between the upper and lower elements 3 and 5. Connection module MI is thus compressed. However, central liner 15 cannot undergo this displacement as it is integral with the upper fixed element 3 of the connection module Ml. This thus causes injection module M2 to move relative to liner 15, which isolates injector I following axial displacement of opening 90 of liner 15. This opening 90 no longer faces opening 88 in lower sleeve 39 which ensures fluid communication between the inside of liner 15 and the main channel 65 of each injector I.

During this preliminary treatment, drilling mud is pumped inside tubing T. This mud passes freely through tool 1, in particular injection module M2, but cannot pass through the injectors I.

Once the critical zone diameter enlarging operation has been completed, no further reaction force is exerted on drilling tool 150. Return spring 25 can relax to force apart the upper and lower elements 3 and 5 of connection module M1 which is no longer under compression.

Dart 105 is dropped inside tubing T and pushed by the base fluid which is pumped behind it. When dart 105 reaches central liner 15 of injection module M2, its fall is stopped by retaining fingers 110. Central liner 15 is thus blocked by dart 105 which forms a sealed cap to force base fluid to flow through the injectors I.

In this situation, illustrated in FIG. 7, the pressure in central liner 15 increases, and creates a pressure differential at the terminals of piston 64 of injectors I. The pressure of the base fluid acting on collar 68 located at the rear of piston 64 causes the piston 64 to move axially which partially disengages needle 80 to open secondary channel 70 and the activator stored in reservoir R can then be ejected simultaneously with the base fluid which is being ejected by the central channel of injectors I.

An increase in the pressure in the liner causes base fluid to flow from chamber 48 in enclosure 40 which tends to deform membrane M towards reservoir R while there is no pressure equilibrium between chamber 48 and reservoir R and to compensate for the volume of activator which is forced from reservoir R. Membrane M acts as a piston.

Injectors I thus simultaneously project the base fluid and its activator against the wall of the critical zone as tool 1 rises. Given that there is no further continuous circulation of fluid inside the tool because of the presence of dart 105 in central liner 15, the shutters 125 are automatically deployed by the action of springs 140. The base fluid ejected by injectors I sets due to the action of the activator and starts to bear on the upper conical portion of shutters 125. The base fluid creates resistance which tends to oppose the tool 1 being raised. The upward speed of tool 1 is advantageously regulated as a function of this resistance to obtain a coating of substantially constant diameter over the entire length of the critical zone. The more the resistance increases due to an increase in the level of base fluid and/or the rate of setting of the base fluid, the higher must be the speed of tool 1. Conversely, the lower the resistance, i.e., when the base fluid is still liquid, the lower must be the upward speed of the tool 1.

A sufficient quantity of base fluid is pumped to treat all of the critical zone, and then mud is pumped to clean injectors I to remove all traces of base fluid.

After this cleaning operation, pumping is stopped and tool 1 is lowered into the borehole so that the end of drilling tool 150 comes into contact with the bottom of the hole. This contact causes a reaction force which, as explained above when the critical zone was enlarged, causes connection module M1 to compress. Injection module M2 is then displaced with respect to central liner 15 by a height which is sufficient to move retaining fingers 110 apart and to allow dart 105 to be pumped to the bottom of central liner 15 to re-establish circulation of drilling mud through the well. Once dart 105 has been freed, drilling tool 150 is disengaged from the hole bottom to re-establish circulation of fluid through tool 1, which removes the pressure differential in the terminals of injectors I, and return spring 76 returns the piston 64 to its initial position where the needle 80 again blocks outlet channel 70 through which activator was ejected (FIG. 8).

The control means for injectors I can be reactivated by dropping a new dart 105, in particular when the treatment is carried out in several successive stages.

In general, tool 1 can extend over a length of the order of 15 meters, for example.

It should be noted that the tool control means uses only hydraulic and/or mechanical means, i.e., there is no need for additional means, such as electrical cables and/or additional ducts, which would inevitably make the structure of the tool more complex.

The method and the tool of the invention can treat the entire length of a critical zone in a borehole continuously when the tool is connected to a coiled tubing. In contrast, this treatment is carried out in successive steps when the tool is connected to a drill pipe and when the length of the critical zone is longer than one component module of the drill pipe which corresponds substantially to the height of the well rig.

Variations can, of course, be made to the tool described above. In particular, its slip formwork C can be formed from a sealed envelope which is extensible and filled with, a fluid which would be controlled in analogous fashion to the shutters.

We claim:

1. A method of treating the wall of a critical zone in a borehole, the method consisting in reinforcing the wall of the critical zone with a coating obtained from a base fluid which is pumped from the surface to a tool to be projected from an injector against the wall of the critical zone where it forms said coating once it has set, the method being characterized in that it consists in storing at least one additive or activator in liquid form in a reservoir of the tool, and in pumping the base fluid through tubing to a channel which passes through the tool and creating a pressure differential in the terminals of the injector by at least temporarily obstructing the channel of the tool by dropping a projectile from the surface in the tubing and pushing it with base fluid pumped through the tubing to reach the channel of the tool, and stopping the projectile with a retractable retaining means so as to increase the pressure inside the channel of the tool to automatically control the injector and to cause the base fluid and its additive to be projected simultaneously against the wall of the critical zone.

2. A method according to claim 1, characterized in that it consists in lifting the tool through the length of the critical zone, simultaneously projecting the base fluid and the additive by means of at least one injector, and providing the tool with slip formwork located beneath the injector to maintain the base fluid on the wall of the critical zone for a time equal to that required for the base fluid to set.

3. The method according to claim 2, characterized in that it consists in using the resistance provided by the base fluid during setting, which resistance is exerted on the upper portion of the slip formwork and tends to oppose the upwards movement of the tool, to obtain a coating with an inside diameter which is substantially constant along the entire length of the critical zone.

4. A method according to claim 3, characterized in that it consists in measuring the force of this resistance provided by the base fluid during setting to regulate the rate at which the tool is raised along the critical zone.

5. The method according to claim 2, characterized in that it consists in providing the slip formwork with an overall cylindrical shape the diameter of which can be regulated and providing the upper portion of the slip formwork with a conical shape.

6. A method according to claim 2, characterized in that it consists in providing the slip formwork with a length which is calculated to allow the base fluid to set during the upward movement of the tool along the critical zone.

7. A method according to claim 1, characterized in that it consists, from the surface, in causing the base fluid to be projected against the wall of the critical zone simultaneously with its additive.

8. The method according to claim 1, characterized in that it consists in stopping simultaneous projection of the base fluid and its additive by freeing the projectile from the tool channel, and in that it comprises freeing the projectile by exerting a mechanical force on the retaining means to retract it and re-establish fluid circulation through the tool channel.

9. A method according to claim 1, characterized in that it consists of enlarging the diameter of the critical zone prior to simultaneous projection of the base fluid and its activator.

10. A tool for treating at least the wall of a critical zone in a borehole, the tool being mounted at the end of tubing to receive a base fluid which is pumped from the surface through the tubing and to project it against the wall of a critical zone detected in a borehole at any depth, the tool being characterized in that it comprises at least

- a reservoir in which an activator is stored to activate setting of the base fluid pumped from the surface and guided to the tool;
- at least one injector to project both the base fluid and the activator simultaneously against the wall of the critical zone, the injector including an annular space that permanently communicates with the reservoir; and
- a control means activated from the surface to control the operation of the injector.

11. A tool according to claim 10, characterized in that it is constituted by at least:

- a connection module for connecting the tool to the tubing;
- an injection module which comprises at least one reservoir containing an additive or activator in liquid form, and at least one injector to project both the base fluid and the activator simultaneously against the wall of the critical zone; and
- a module forming slip formwork located beneath the injector to keep the projected base fluid on the wall in the critical zone for a time equal to that required for the base fluid to set, while the tool is being raised.

12. A tool according to claim 11, characterized in that the injection module comprises a movable or deformable means for compensating for the pressure and volume in the reservoir during simultaneous projection of the base fluid and activator, the movable or deformable means being automatically controlled by the fluid pumped through the tool.

13. The tool according to claim 12, characterized in that the pressure and volume compensating means is constituted by an elastically deformable element such as a rubber membran.

14. The tool according to claim 12, characterized in that the injection module comprises an enclosure the volume of which is separated into two portions by the pressure and volume compensating means, namely into a first chamber in which fluid pumped through tool is circulated, and a second chamber. forming the reservoir which is in communication with the injector.

15. A tool according to claim 14, characterized in that the enclosure is constituted by a cylindrical wall mounted coaxially around the body of the injection module and closed by an annular upper cap and by an annular lower cap fixed on the body.

16. The tool according to claim 14, characterized in that the injection module comprises a central liner in communication with the tubing through the connection module, and in that the central liner communicates with the chamber via an upper radial channel passing through the body and a lateral opening passing through the central liner, and via a lower radial channel passing through the body and a lower lateral opening passing through the central liner to ensure circulation of fluid in the chamber from the fluid pumped through the central liner.

17. The tool according to claim 16, characterized in that the injector is controlled from the surface by a control means actuated from the surface.

18. The tool according to claim 17, characterized in that the control means is constituted by a projectile such as a spike or dart which is dropped from the surface in the tubing and in that it comprises a retractable retaining means lodged in the central liner to stop the descent of the projectile, the retaining means being located beneath the injector.

19. A tool according to claim 18, characterized in that the retaining means is constituted by retractable fingers lodged at the same level in lateral openings passing through the central liner.

20. A tool according to claim 18, characterized in that fluid communication is ensured by at least one duct which passes through reservoir, one end of which opens near the top at the exterior of the tool and the other end of which opens near the bottom into the inside of the tool at a level located beneath the retaining means and projectile.

21. The tool according to claim 16, characterized in that the connection module comprises two elements, upper element and lower element, partially inserted one inside the other by means of respective grooves, and held apart from each other by a spring, and in that the central liner is integral with the upper element.

22. The tool according to claim 11, characterized in that injector is movable between two positions and comprises a piston slidably mounted in a fixed bush mounted in a lateral opening of body of injection module, and in that the piston has a main central channel passing therethrough to eject base fluid and at least one secondary channel to simultaneously eject the activator contained in the reservoir.

23. A tool according to claim 22, characterized in that the piston is mounted in sliding and sealed contact with the bush by means of a front collar and a rear collar, and in that the front collar has the secondary channel passing axially therethrough.

24. A tool according to claim 23, characterized in that between them the front and rear collars :define an annular space, in that an annular rib projecting from the internal wall of the bush penetrates into this annular space, and in that the two ends of a spring lodged in this space and mounted around the piston bear respectively on the rib and the rear collar of the piston.

25. A tool according to claim 24, characterized in that an elongate finger or needle carried by the rib engages in the secondary channel to obstruct or partially free the fluid flow section of this channel.

26. A tool according to claim 22, characterized in that a channel passes radially through the rib and the bush and communicates with a peripheral groove provided in the outer wall of the bush, and in that a channel passes through the body of the injection module and through the lower cap of the vessel to put the reservoir into communication with the secondary channel for ejecting the activator.

27. A tool according to claim 11, characterized in that the slip formwork is constituted by shutters which form an overall cylindrical envelope covered by an elastic membrane, and in that each shutter has a conical portion near each of its ends.

28. A tool according to claim 10, characterized in that fluid communication is ensured between the outside and inside of the tool for volume compensation while the tool is rising along the critical zone.

* * * * *